US007310853B2

(12) United States Patent
Cho

(10) Patent No.: US 7,310,853 B2
(45) Date of Patent: Dec. 25, 2007

(54) AIR-FLOWING DIRECTION DISTRIBUTOR OF AN INDUSTRIAL DUST-COLLECTOR

(76) Inventor: Kuo-Chin Cho, Floor 2, No. 7, Alley 46, Lane 478, Section 1, An Ho Road, Tainan (TW)

( * ) Notice: Subject to any disclaimer, the term of this patent is extended or adjusted under 35 U.S.C. 154(b) by 661 days.

(21) Appl. No.: 10/901,144

(22) Filed: Jul. 29, 2004

(65) Prior Publication Data

US 2006/0021181 A1 Feb. 2, 2006

(51) Int. Cl.
*A47L 9/00* (2006.01)

(52) U.S. Cl. ..... 15/330; 15/347; 15/353; 15/246.2

(58) Field of Classification Search ..... None
See application file for complete search history.

(56) References Cited

U.S. PATENT DOCUMENTS 4,933,017 A * 6/1990 Brzoska ..... 134/21
6,902,594 B2 * 6/2005 Cho ..... 55/373
7,107,646 B2 * 9/2006 Cho ..... 15/352

* cited by examiner

*Primary Examiner*—David Redding
(74) *Attorney, Agent, or Firm*—Rosenberg, Klein & Lee

(57) ABSTRACT

An air-flowing direction distributor of an industrial dust-collector is provided with a pipe end at one side to be connected with the pipe of the main body of an industrial dust-collector, and two pipe ends are provided at the other side of the air-flowing direction distributor to be connected with the front end of an air blower. The air-flowing direction distributor is provided with four partition boards in the interior, a passage is provided in each partition board, a movable rod is provided in the interior of the air-flowing direction distributor to penetrate through each passage, and the movable rod is provided with sealing blocks.

2 Claims, 5 Drawing Sheets

AIR-FLOWING DIRECTION DISTRIBUTOR OF AN INDUSTRIAL DUST-COLLECTOR

BACKGROUND OF THE INVENTION

1. Field of the Invention

The present invention relates to an air-flowing direction distributor of an industrial dust-collector with innovatory features, and more particularly to an air-flowing direction distributor which can efficiently make the air be sucked in or exhausted by means of a movable rod and sealing blocks, so as to reduce cost and save installation space.

2. Brief Description of the Prior Art

A conventional air-flowing direction distributor of an industrial dust-collector, referring to FIG. 1, is provided with an air-inlet line 112 and an air-outlet line 113 at the front end of the air blower 111. The air-inlet line 112 is provided with an air filter 1121 on the top, a first valve switch 1122 and a second valve switch 1123 at the bottom of the air filter 1121, and the air-outlet line 113 is provided with a third valve switch 1131 and a forth valve switch 1132.

Referring to FIG. 1, while being operated to suck in air, when the switching device 151 is switched on to start the motor M (or an electric magnetic valve is used) to make the air blower 111 operate, the third valve switch 1131 is opened to let the air flow into the air filter 1121 for the impurities to be filtered, the air circulates in the main body of the industrial dust-collector, and then the air is exhausted outward the air-outlet line 113.

Referring to FIG. 2, while being operated to exhaust air, when the switching device 151 is switched on to start the motor M (or an electric magnetic valve is used) to make the air blower 111 operate, the first valve switch 1122 and the forth valve switch 1132 are opened, the second valve switch 1123 and the third valve switch 1131 are closed, so as to let the air flow into the air filter 1121 for the the impurities to be filtered, the air circulates in the main body of the industrial dust-collector, and then the air is exhausted outward the air-outlet line 113.

However, there are following drawbacks in the above-described structure and operation of the conventional air-flowing direction distributor of an industrial dust-collector 1. Four valve switches are necessary for the conventional air-flowing direction distributor to be operated, and two valve switches must be opened or closed to suck in air or exhaust air. It is not only uneasy to operate but also costs much.

2. It requires much space for the pipes and valve switches for assembly and distribution, so as to add the weight of the industrial dust-collector.

SUMMARY OF THE INVENTION

Therefore, the objective of the present invention is to provide an air-flowing direction distributor of an industrial dust-collector that can substantially obviate the drawbacks of the related conventional air-flowing direction distributor.

An objective of the present invention is to provide an air-flowing direction distributor of an industrial dust-collector that can efficiently make the air be sucked in or exhausted by means of a movable rod and sealing blocks.

Another objective of the present invention is to provide an air-flowing direction distributor of an industrial dust-collector which can reduce cost and save installation space.

Accordingly, an air-flowing direction distributor of an industrial dust-collector in the present invention is provided with a pipe end at one side to be connected with the pipe of the main body of an industrial dust-collector, and two pipe ends are provided at the other side of the air-flowing direction distributor to be connected with the front end of an air blower. The air-flowing direction distributor is provided with four partition boards in the interior, a passage is provided in each partition board, a movable rod is provided in the interior of the air-flowing direction distributor to penetrate through each passage, and the movable rod is provided with sealing blocks.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
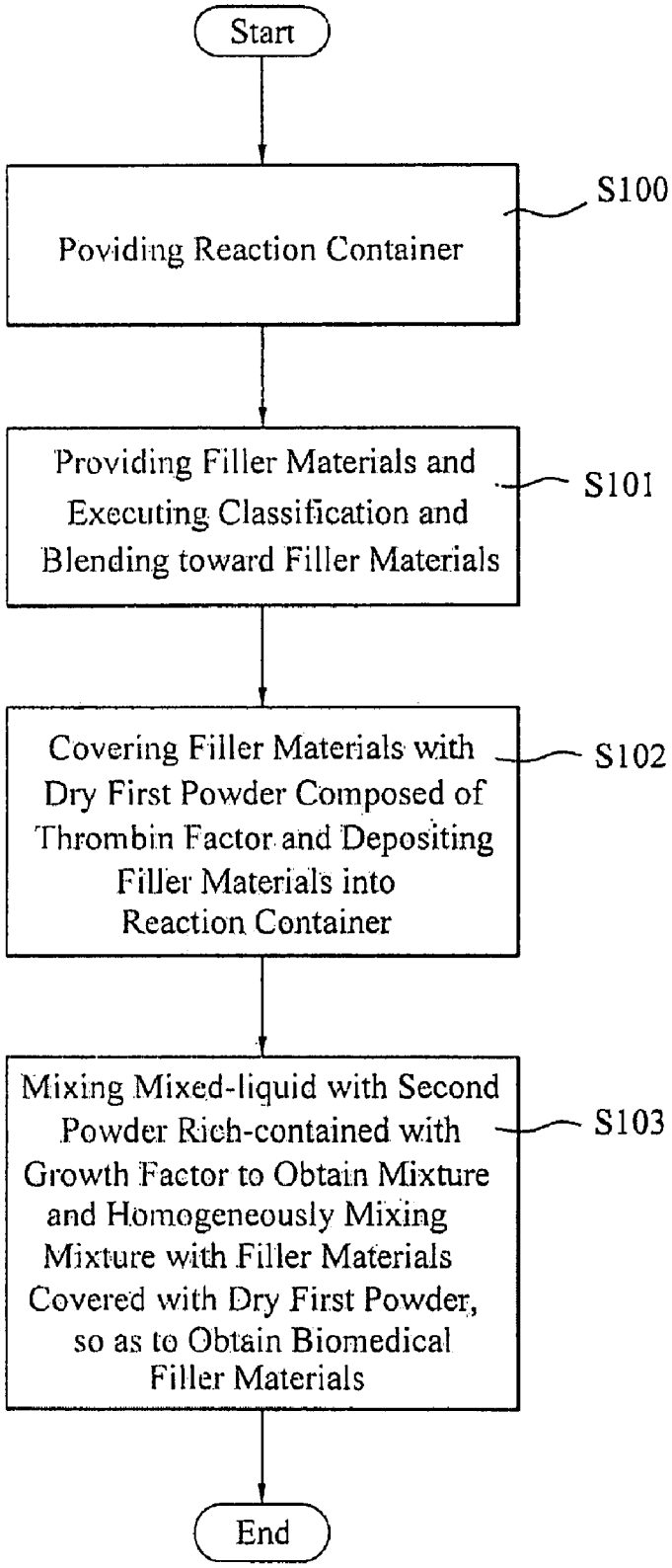
FIG. 1 is a schematic view of a conventional air-flowing direction distributor of an industrial dust-collector when being operated to suck in air.
Figure 2:
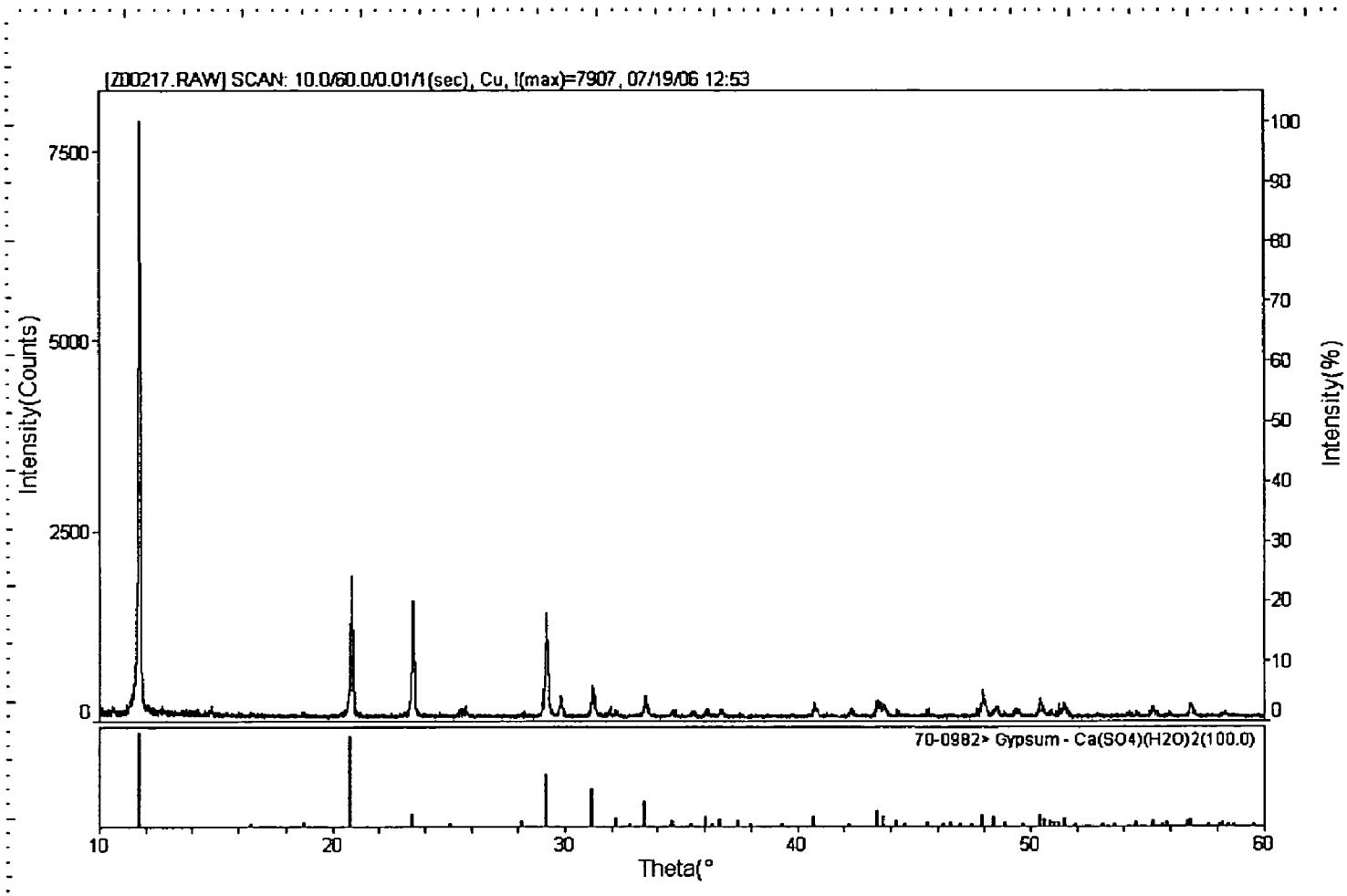
FIG. 2 is a schematic view of a conventional air-flowing direction distributor of an industrial dust-collector when being operated to exhaust air.
Figure 3:
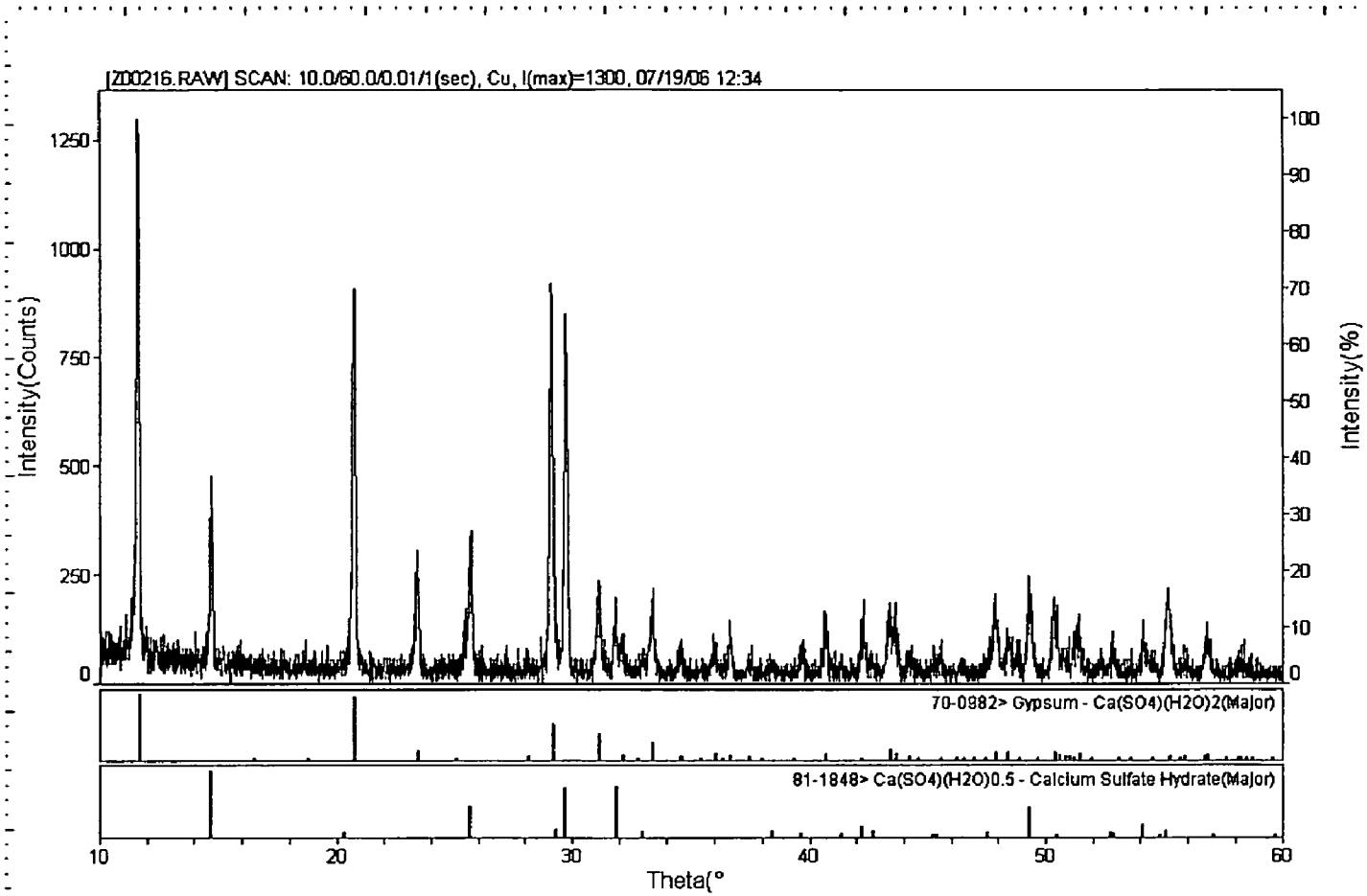
FIG. 3 is a schematic view of an embodiment of the air-flowing direction distributor in accordance with the present invention being provided in an industrial dust-collector.
Figure 4:
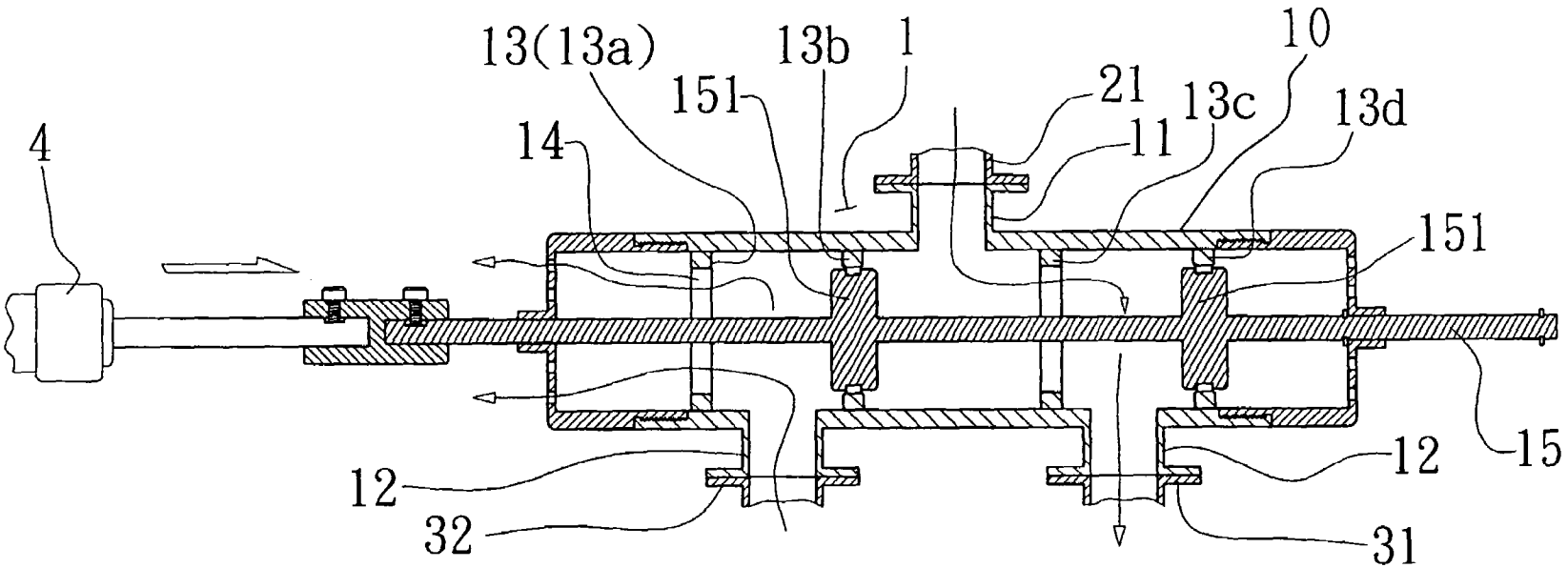
FIG. 4 is a schematic sectional view of an air-flowing direction distributor in accordance with the present invention when being operated to suck in air; and, FIG. 5 is a schematic sectional view of an air-flowing direction distributor in accordance with the present invention when being operated to exhaust air.
Figure 5:
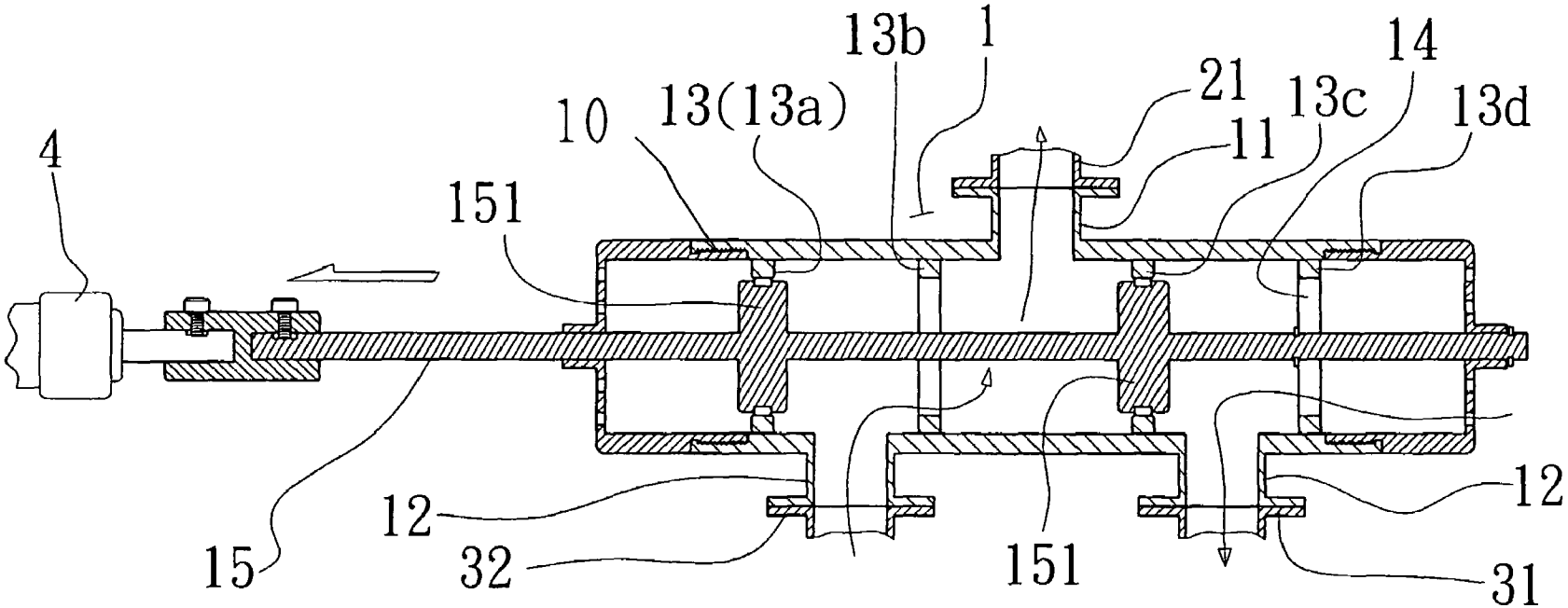

Referring to FIGS. 3, 4 and 5, an embodiment of the air-flowing direction distributor 1 of an industrial dust-collector in the present invention having a housing 10, is provided with a pipe end 11 at one side to be connected with the pipe 21 of the main body 2 of an industrial dust-collector, and two pipe ends 12 are provided at the other side of the air-flowing direction distributor 1 to be connected with the front end of an air blower 3. The air-flowing direction distributor is provided with four partition boards 13 (13*a*, 13*b*, 13*c*, 13*d*) in the interior, a passage 14 is provided in each partition board 13, a movable rod 15 is provided in the interior of the air-flowing direction distributor 1 to penetrate through each passage 14, and the movable rod 15 is provided with sealing blocks 151.

While being operated to suck in air, referring to FIGS. 3 and 4, the switching device is switched on to start the motor M to make the air blower 3 operate, so as for the cylinder 4 to let the movable rod 15 to move rightward for the sealing blocks 151 to seal up the passages 14 of the second partition board 13*b* and the forth partition board 13*d* to prevent air from entering, the air in the pipe 21 of the main body 2 of the industrial dust-collector will flow through the passage 14 of the third partition board 13*c* and enter the other pipe end 12 into the entrance 31 of the air blower 3, the air will then flow through the exit 32 of the air blower 3 into the other pipe end 12, and at last the air will penetrate through the passage 14 of the first partition board 13*a* and the cylinder 4 into the main body 2.

While being operated to exhaust air, referring to FIG. 5, the switching device is switched on to start the motor M to make the air blower 3 operate, so as for the cylinder 4 to let the movable rod 15 to move leftward for the sealing blocks 151 to seal up the passages 14 of the first partition board 13*a* and the third partition board 13*c* to prevent air from entering, the air will flow through the passage 14 of the forth partition board 13*d* into the entrance 31 of the air blower 3 and then flow through the exit 32 of the air blower 3, the air will penetrate through the passage 14 of the second partition board 13*b*, and at last the air will flow into the one pipe end 11 and the pipe 21 of the main body 2 of the industrial dust-collector.

While the preferred embodiments of the invention have been described above, it will be recognized and understood that various modifications may be made therein, and the appended claims are intended to cover all such modifications which may fall within the spirit and scope of the invention.

What is claimed is:

1. An industrial dust collector comprising:

a main housing;

an air blower;

a motor constructed to drive said air blower for drawing dust-containing air into the housing;

an air-flowing directional distributor comprising:

a distributor housing;

a first pipe end being provided on said distributor housing connected with a pipe of the main housing of said collector;

two pipe ends being provided opposite said first pipe end on said distributor housing, each connected with the air blower;

partition boards being provided in the interior of said distributor housing, an air flow passage being provided in each said partition board; and a movable rod being provided in the interior of said distributor housing, constructed and positioned to extend through each air flow passage, said movable rod being provided with blocks which seal the passageways of the partition boards.

2. The collector as recited in claim 1, wherein said directional distributor is provided with four partition boards in the interior of said distributor housing and a passageway is provided in each said partition board.

* * * * *